US006053603A

United States Patent [19]

Ito

[11] Patent Number: 6,053,603

[45] Date of Patent: Apr. 25, 2000

[54] DEVICE AND METHOD FOR REFILLING AN INK CARTRIDGE

[75] Inventor: Hiroyuki Ito, Chatsworth, Calif.

[73] Assignee: Mitsubishi Pencil Corporation of America, Chatsworth, Calif.

[21] Appl. No.: 08/921,201

[22] Filed: Aug. 27, 1997

[51] Int. Cl.[7] ..... B41J 2/175

[52] U.S. Cl. ..... 347/85

[58] Field of Search ..... 347/85–87; 141/319, 141/330, 364, 366, 18

[56] References Cited

U.S. PATENT DOCUMENTS

| | | | |
|---|---|---|---|
| 5,479,968 | 1/1996 | Sanchez et al. | 141/110 |
| 5,595,223 | 1/1997 | Hayao | 141/375 |
| 5,689,290 | 11/1997 | Saito et al. | 347/7 |

FOREIGN PATENT DOCUMENTS 6-106729 4/1994 Japan .

*Primary Examiner*—N. Le
*Assistant Examiner*—Michael Nghiem
*Attorney, Agent, or Firm*—Koda & Androlia

[57] ABSTRACT

A used, empty ink cartridge for, for instance, a computer printer being refilled by an ink refilling adapter that includes an ink conduit and an elastic member such as a sponge provided on the adapter. The ink conduit is pressed into the ink cartridge, thus squeezing the elastic member, until the tip portion of the ink conduit penetrates into an ink absorbing material installed inside the cartridge; and then upon the removal of the pressing force, the squeezed elastic member is allowed to expand so as to regain its original shape, thus lifting the tip portion of the ink conduit from the ink absorbing material. As a result, an empty space is formed in the ink absorbing material inside the ink cartridge, so that ink introduced into the ink conduit can smoothly flow out into the empty space and then is absorbed by the ink absorbing material, thus refilling the ink cartridge.

10 Claims, 5 Drawing Sheets

DEVICE AND METHOD FOR REFILLING AN INK CARTRIDGE

BACKGROUND OF THE INVENTION

1. Field of the Invention

The present invention relates to a device and method for refilling an ink cartridge and more particularly to a device and method for refilling an ink cartridge that contains therein an ink absorbing material such as sponge.

2. Prior Art

Various types of ink cartridges that are used in computer printers are manufactured and marketed. One type of ink cartridge has an ink reservoir tank to store ink therein, and another type of ink cartridge includes an ink absorbing material such as a sponge inside to store ink. When this type of ink cartridge is refilled, ink is dropped onto the ink absorbing material so as to let the ink permeate the ink absorbing material. Another way to refill this type of ink cartridge is to introduce a pipe into the cartridge so that the pipe penetrates into the sponge and then ink is introduced into the pipe from an ink supply pack, thus allowing the ink to flow down the pipe and to be absorbed by the ink absorbing material.

When the cartridge is refilled by way of letting the ink drop onto the ink absorbing material, the ink first drops on the surface of the ink absorbing material and then gradually permeates downward so as to be absorbed and stored in the ink absorbing material. However, different cartridges use different types of ink absorbing materials which have various characteristics. In addition, even in the cartridges that have the same ink absorbing material, the absorbing efficiency of the ink differs depending upon the condition of the ink absorbing material due to the ambient and inside temperatures, period of use of the cartridges, etc. Occasionally, the refilling ink overflows and comes out of the ink filling aperture of the cartridge even before the cartridge is fully refilled.

When the cartridge is refilled via a pipe that is brought into contact with the ink absorbing material inside the cartridge, a hazard of overflowing is less likely to occur; however, since the ink outlet of the pipe is in direct contact with the ink absorbing material, the ink absorbing material tends to hinder a smooth outflow of the ink, thus allowing the refilling ink to fill up the pipe. So as to avoid this, syringes are often used in order to forcefully transfer the ink into the ink cartridge. However, the flow of the ink by a syringe receives a resistance from the ink absorbing material; and as a result, the ink refill process requires a greater force to push the ink out of the syringe. In addition, the speed of the ink being forced out of the pipe can vary depending upon the resistance from the ink absorbing material; and, it is always necessary to apply an appropriate force to force out the ink from the syringe for each one of the different cartridges to be refilled.

SUMMARY OF THE INVENTION

Accordingly, the object of the present invention is to provide an ink refilling device and method which smoothly refills ink by way of gravity into an ink cartridge that contains therein an ink absorbing material.

It is another object of the present invention to provide an ink refilling device and method that refills an ink into an ink cartridge, which contains therein an ink absorbing material, regardless of the condition of such an absorbing material.

The objects of the present invention are accomplished by a unique structure of the ink refilling device that is set on the upper surface of a used, empty ink cartridge which contains an ink absorbing material therein, and the ink refilling device essentially comprises a flat base plate which has an ink transfer conduit provided so as to penetrate the base plate and an elastic member provided on one side of the base plate so that the ink is refilled via the ink transfer conduit after forming an empty cavity in the ink absorbing material of the ink cartridge by pressing the base plate so as to squeeze the elastic member and to have the ink transfer conduit penetrate into the ink absorbing material and then letting the ink transfer conduit lift by allowing the squeezed elastic member to expand to regain its original shape.

Since an empty space is formed in the ink absorbing material of the ink cartridge when the ink transfer conduit is lifted by the elastic member regaining its original shape from the squeezed state and the tip end of the ink transfer conduit remains inside this empty space, the ink passing through the ink transfer conduit can drop by gravity onto the ink absorbing material via the empty space, and the ink can easily and smoothly be transferred from the ink transfer conduit to the ink absorbing material, thus refilling the ink cartridge.

DETAILED DESCRIPTION OF THE INVENTION

Figure 1:
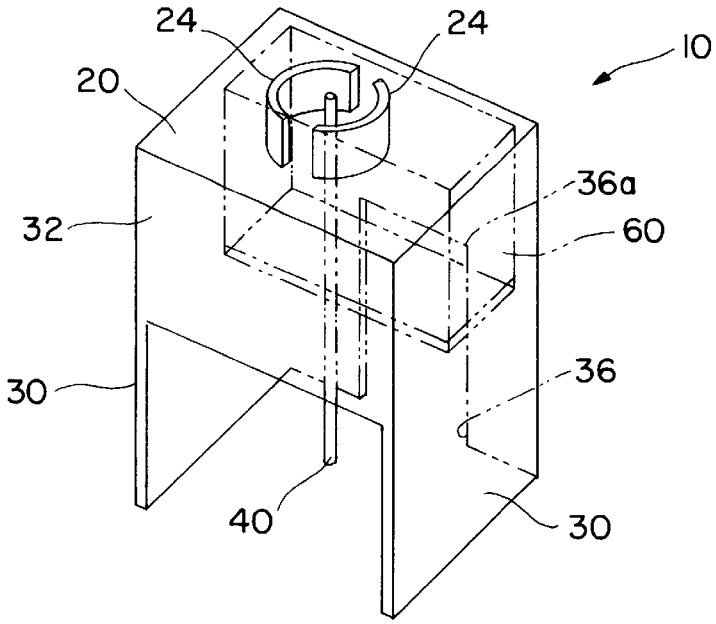
FIG. 1 is a perspective view showing the first embodiment of the ink refilling adapter according to the present invention.

As seen from FIG. 1, the ink refilling adapter of the present invention, generally referred to by the reference numeral 10, comprises a base plate 20, an ink transfer conduit 40, and an elastic member 60.

Figure 2A:
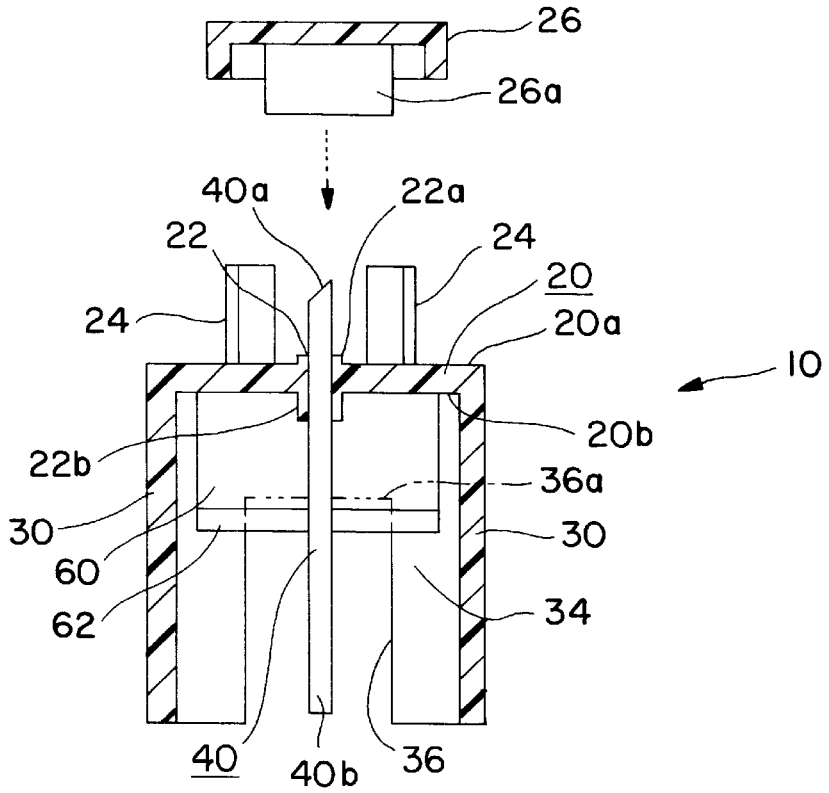
FIG. 2(*a*) is a front elevational view shown in section of the first embodiment of the ink refilling adapter having an ink transfer conduit comprising a single pipe, the protective cap for the conduit being shown separately, and FIG. 2(*b*) shows the same having an ink transfer conduit comprising two separates pipes.
Figure 2B:
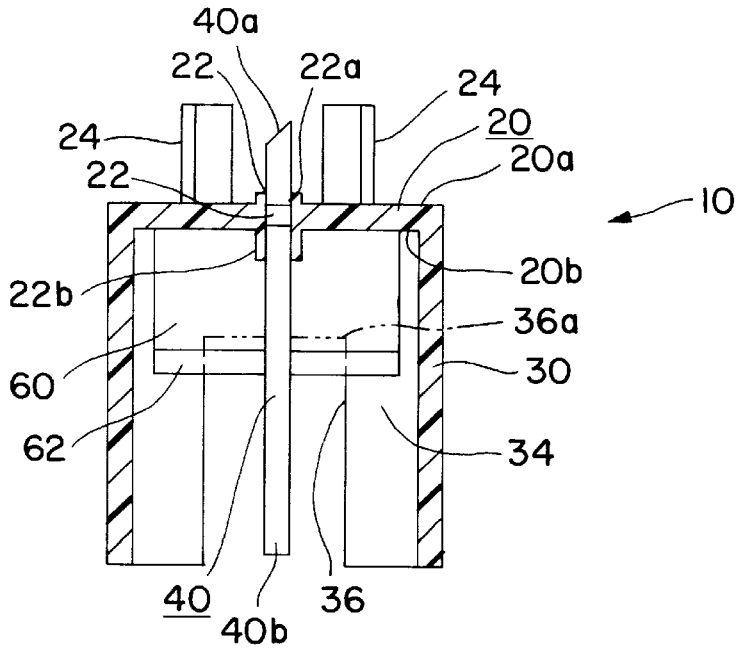
Figure 4A:
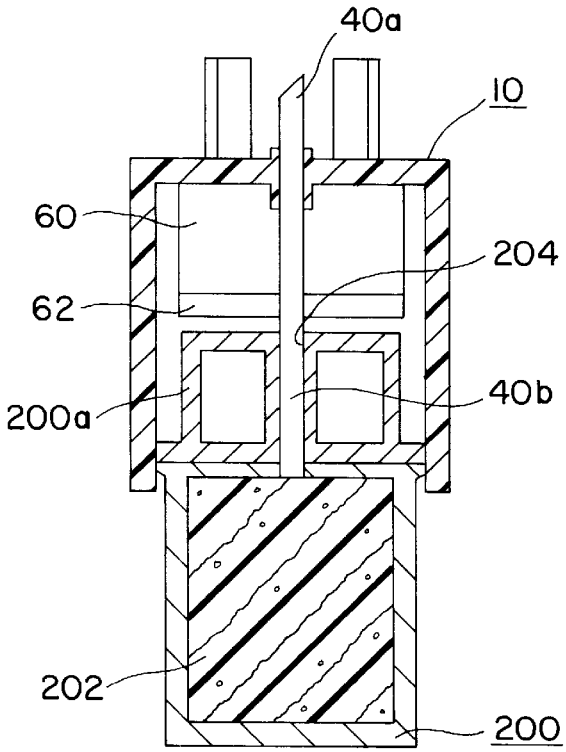
FIGS. 4(*a*) through 4(*d*) illustrate the ink refilling process, shown in sections, using the adapter of the first embodiment.
Figure 4B:
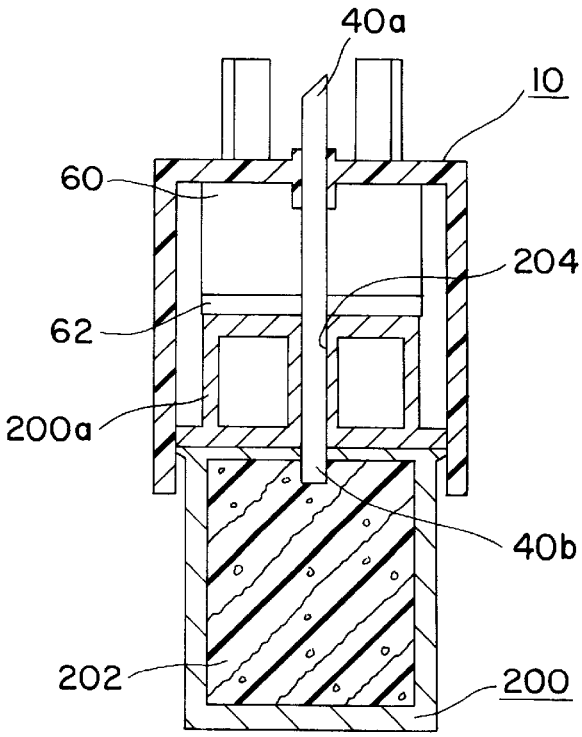
Figure 4D:
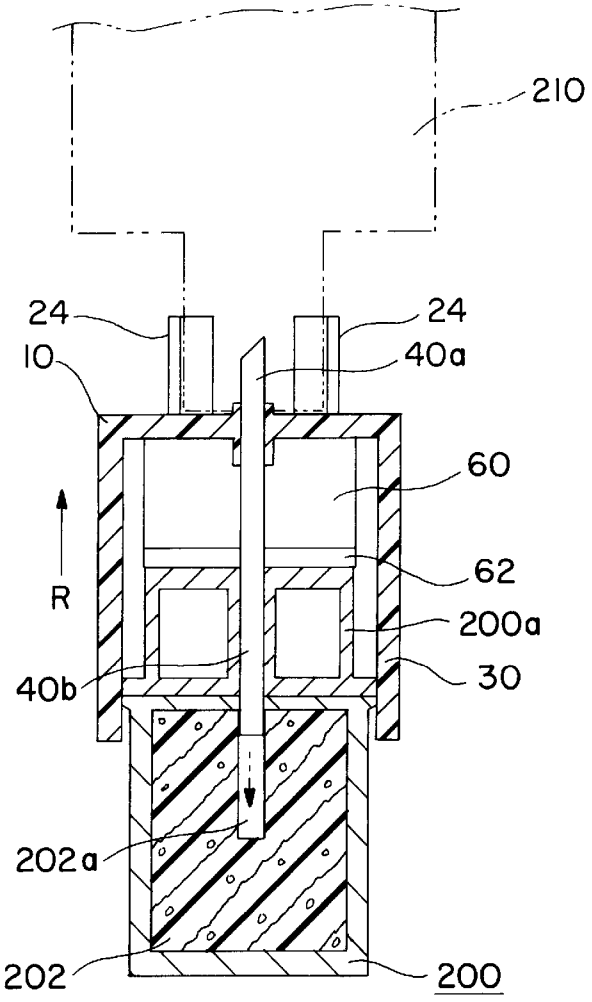
Figure 4C:
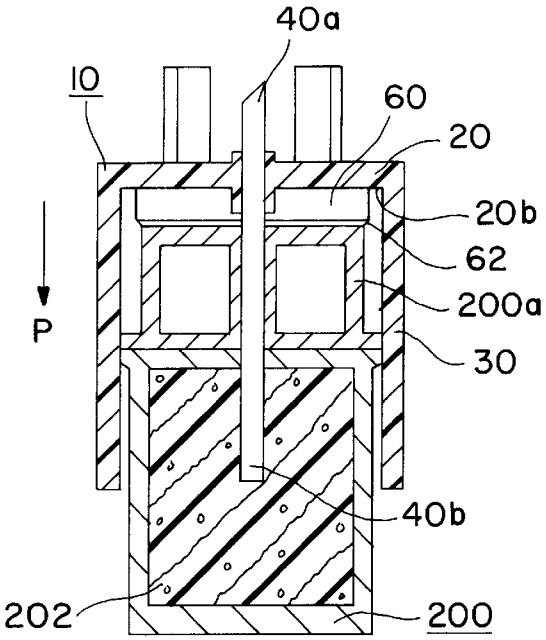
Figure 5A:
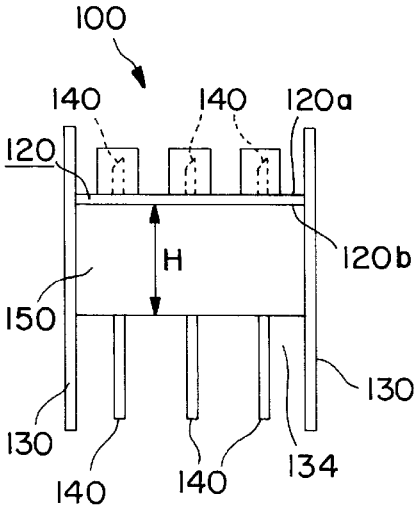
FIG. 5(*a*) is a front elevational view of the ink refilling adapter according to the second embodiment of the present invention, FIG. 5(*b*) is a top view thereof, FIG. 5(*c*) is a bottom view thereof, and FIG. 5(*d*) shows the ink refilling adapter of the second embodiment placed on an ink cartridge.
Figure 5B:
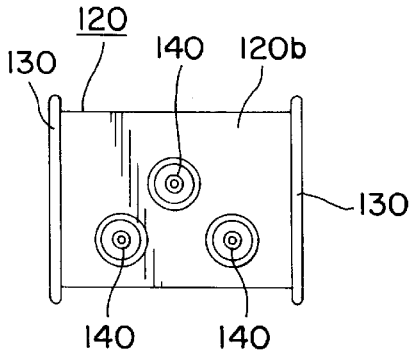
Figure 5C:
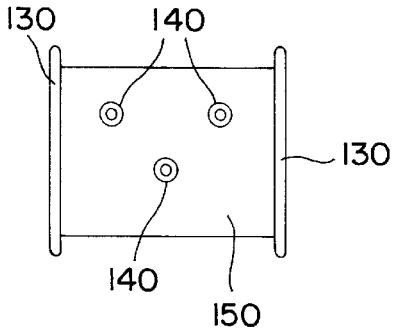
Figure 5D:
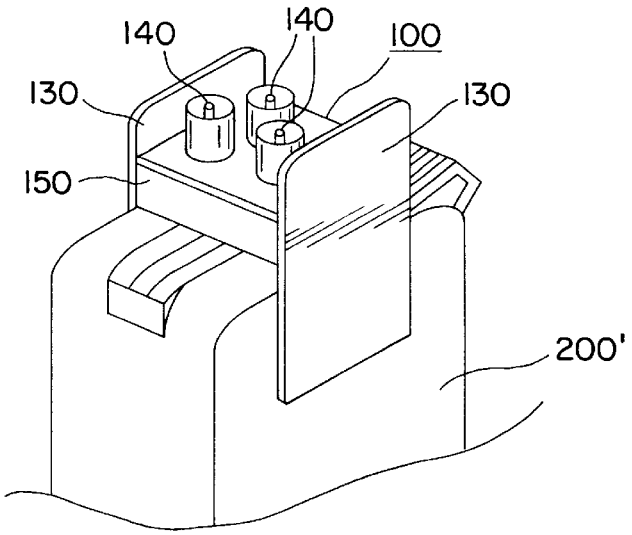

The base plate 20 is typically a rectangular plane plastic body having a size so as to cover substantially half (see FIG. 3) the top face of an ink cartridge 200 upon which the adapter 10 is used; and it has, as best seen from FIG. 2(*a*), an outer surface 20*a* and an inner surface 20*b*. The base plate 20 is further provided with a through hole 22; and an outer support 22*a* is formed so as to project on the outer surface 20*a* and surround the through hole 22, and an inner support 22*b* is formed so as to project on the inner surface 20*b* so as to surround the through hole 22. The position of the through hole 22 is selected so that the through hole 22 positionally corresponds to an air hole (or fluid communication hole) of the ink cartridge 200.

Figure 3:
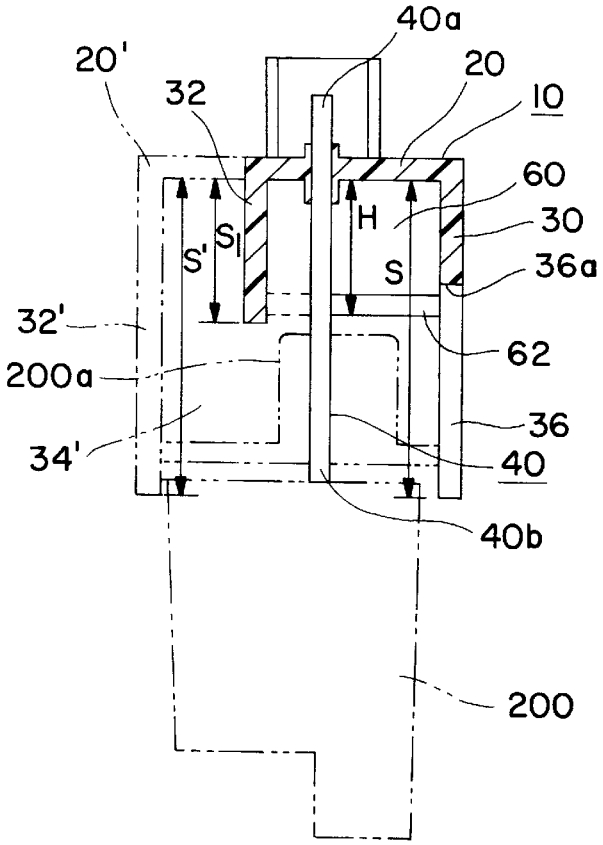
FIG. 3 is a side elevational view of the ink refilling adapter of the first embodiment shown in section.

As seen from FIG. 2(*a*) and FIG. 3, three (3) plane side walls 30 and one front wall 32, which are typically made of plastic, are formed so as to extend at substantially right angles from the edge portions of the base plate 20, thus forming an enclosed, interior space 34 by the base plate 20 and surrounding walls or the side and front walls 30 and 32. The side walls 30 have a specific length (or height) S, and the front wall 32, has a specific length (or height) S1 that is smaller (or shorter) than the side walls 30 as will be described below. In addition, an observation cut-out 36 is formed, as best seen from FIGS. 1 and 3, in the side wall that is located to oppose to the front wall 32. This observation cut-out 36 is used as an ink overflow indicator as will be described below.

In the structure above, the interior space 34 is obtained from the base plate 20 that has a size so as to cover substantially half the top face of the ink cartridge 200 and the side and front walls 30 and 32 that have different lengths (or heights) S and S1. However, as shown by the dotted lines in FIG. 3, the interior space 34' can be obtained from a base plate 20' which has substantially the same size as the top face of the cartridge 200 and side and front walls 30 and 32' which all have the same length (or height) S', thus covering the entire (not half) top face of the cartridge 200.

Furthermore, the ink refilling adapter 10 has an ink transfer conduit 40. The ink transfer conduit 40 is, as shown in FIG. 2(*a*), a single metal pipe that has a pointed end and which penetrates at substantially a right angle the base plate 20 via the through hole 22 thereof and is securely held by the outer and inner supports 22*a* and 22*b*. The ink transfer conduit 40 comprises an outside pipe portion 40*a* that projects out of the outer surface 20*a* of the base plate 20 and an inside pipe portion 40*b* that projects out of the inner surface 20*b* of the base plate 20. The inside pipe portion 40*b* has a specific length; and it is, typically, greater (longer) than the height S1 of the front wall 32 and is slightly smaller (shorter) than the length S of the side walls 30.

Unlike the ink transfer conduit 40 that is as described above, the conduit 40, as shown in FIG. 2(*b*), can be comprised of two separates pipes, an outside pipe portion 40*a* and an inside pipe portion 40*b*, both typically made of metal. The outside pipe portion 40*a* is securely coupled in the outer support 22*a* of the base plate 20; and one end (upper end) of the inner pipe 40*b* is securely coupled in the inner support 22*b* of the base plate 20, respectively. Thus, the outer pipe 40*a* and the inside pipe portion 40*b* communicate with each other via the through hole 22 of the base plate 20. Another end (upper end) of the outside pipe portion 40*a* is pointed for allowing an easy connection to an ink supply container (described below). The inside pipe portion 40*b* is, typically, greater (longer) than the height S1 of the front wall 32 and is slightly smaller (shorter) than the length S of the side walls 30.

A pair of arc-shaped guide collars 24 are formed on the outer surface 20*a* of the base plate 20 so as to surround the outside pipe portion 40*a* with a space in between. The guide collars 24 are slightly higher than the outside pipe portion 40*a* so as to guide and hold the neck portion of an ink supply container during the ink refill process and also to protect the fingers of the user from the pointed end of the ink transfer conduit 40.

The guide collars 24 can be covered by a safety cap 26 (not shown in FIG. 2(*b*)). The safety cap 26 is provided therein with an ink absorbing pad 26*a* which is a cotton, urethane, etc., hardened and shaped into, for example, a cubical, cylindrical or rectangular form. The ink absorbing pad 26a has a sufficient thickness that covers the exterior portion of ink transfer conduit 40 (or the outside pipe portion 40*a*) when the safety cap 26 is placed on the guide collars 24.

Furthermore, the elastic member 60 is provided in the interior space 34 that is defined by the base plate 20 and the side and front walls 30 and 32. The elastic member 60 is in the form of a rectangular parallelpiped block made of a material that can absorb liquid and is squeezable and expandable by itself so as to produce, when expands, a resilient or rebounding force, such as a sponge, typically a synthetic sponge. Typically, the elastic member 60 has a volume so as to fit and stay in the interior space 34, and it can be glued at its upper end surface to the inner surface 20*b* of the base plate 20. The elastic member 60 may include, as a part thereof, an ink absorbing layer 62 attached to the under surface of the elastic member 60. The ink absorbing layer 62 is a pad made of a material that can absorb ink such as a cotton and is glued to the elastic member 60.

The elastic member 60 is, as best seen from FIG. 3, located between the inside pipe portion 40*b* and one of the side walls 30, which opposes the front wall 32; and one side that faces the inside pipe portion 40*b* is in contact with the outer circumferential surface of one side (opposed to the front wall 32) of the inside pipe portion 40*b*. The height or thickness H of the elastic member 60 in a normal state (in other words, before being squeezed as described below) is smaller than the length of the inside pipe portion 40*b*; and typically it is smaller than the length S1 of the front wall 32. The position of the observation cut-out 36 is selected so that the upper edge thereof is slightly higher than the lower surface of the elastic member 60, thus allowing a part of the elastic member 60 and/or the ink absorbing layer 62 to show or be exposed through the observation cut-out 36.

The elastic member 60 in the shown embodiment is, as described above, located between the or inside pipe portion 40*b* and one of the side walls 30 so as to be in contact with the outer circumferential surface of one side of the inside pipe portion 40*b*; however, the elastic member 60 can be formed in a size large enough to surround and come in contact with the entire circumferential surface of the inside pipe portion 40*b* within the range corresponding to the height H of the elastic member 60 as shown by the dotted lines in FIG. 3.

In use, the ink refilling adapter 10 is placed on an ink cartridge 200. The ink cartridge 200 contains therein, as shown in FIGS. 4(*a*) through 4(*d*), an ink absorbing material 202 that is made of, for instance, a hardened or compressed synthetic sponge so as to store ink in the cartridge 200. The ink cartridge 200 shown as an example in the embodiment of the present invention is provided with a raised box section 200*a* formed on the top face thereof Before refilling the cartridge 200 with ink, a sealing film which closes an air hole (or fluid communication hole) 204 provided on the raised box section 200*a* of the ink cartridge 200 is removed. The air hole 204 can be enlarged in diameter by an appropriate tool so that the ink transfer conduit 40 of the adapter 10 can be smoothly brought into the cartridge 200.

The lower end of the inside pipe portion 40*b* of the ink refilling adapter 10 is inserted into the ink cartridge 200 through the air hole 204 so that the lower end of the ink transfer conduit 40 comes into contact with the ink absorbing material 202 of the ink cartridge 200 as shown in FIG. 2(*a*), and then the adapter 10 is pushed by hand downward or in the direction of the inside of the cartridge 200 until the lower surface of the elastic member 60 (or the ink absorbing pad 62) is brought into contact with the upper surface of the raised box section 200*a* of the cartridge 200 so that the lower end of the ink transfer conduit 40 enters into the ink absorbing material 202 as shown in FIG. 4(*c*). In this case, corners defined by side walls 30 are aligned with the corners of the ink cartridge 200, thus serving as a guide of the adapter 10 to be pushed and moved downward.

Then, the adapter 10 is further pushed down by hand toward the inside of the cartridge 200 in the direction of arrow P, as shown in FIG. 4(*c*) so that the inside pipe portion 40*b*. of the ink transfer conduit 40 advances and the lower portion thereof penetrates into the ink absorbing material 202. During this advancement effected by the further pushing of the adapter 10, the elastic member 60 is squeezed between the inner surface 20*b* of the base plate 20 and the upper surface of the raised box section 200*a* of the ink cartridge 200. The adapter 10 is pushed until the lower end of the inner support 22*b* of the base plate 20 comes into contact with the upper surface of the raised box section 200*a* so that the further pushing-in of the adapter 10 and the advancement of the inside pipe portion 40*b* become impossible. Such a further inward advancement of the inside pipe portion 40*b* is also stopped in case the thickness of the fully squeezed elastic member 60 is greater than the height of the inner support 22*b*.

When the thus further advancement is stopped, the hand is removed from the ink refilling adapter 10. When the hand is thus removed, in other words, when the pressing force is removed from the ink refilling adapter 10, the elastic member 60 that has been squeezed starts expanding, gradually regaining its original block shape and thus raising the ink refilling adapter 10 and therefore the inside pipe portion 40*b* that is secured to the base plate 20 of the adapter 10 in the direction of arrow R in FIG. 4(*d*). When the elastic member 60 is thus raised in the ink absorbing material 202 for the distance in which the elastic member 60 has fully expanded from the squeezed state and regained its original shape, an empty space or cavity 202*a* is formed and remains in the ink absorbing material 202 with the lower end of the inside pipe portion 40*b* is inside this empty space or cavity 202*a* as seen from FIG. 4(*e*). The empty space or cavity 202*a* is formed in the ink absorbing material 202 because the ink absorbing material 202 is made of a hardened or compressed sponge and is pushed aside by the inside pipe portion 40*b*.

In addition, it is apparent that the ink transfer conduit 40, particularly the inside pipe portion 40 has a length long enough to penetrate into the ink absorbing material 202 when the elastic member 60 is squeezed and to remain at its lower end inside the empty space or cavity 202*a* when the elastic member 60 expands and regains its original shape.

Accordingly, when an ink supply container 210 is connected to the outside pipe portion 40*a* of the ink transfer conduit 40 via its pointed end, the ink inside the ink supply container 210 flows out of the ink supply container 210, passes through the outside pipe portion 40*a* and the inside pipe portion 40*b* and then flows out from the lower end of the inside pipe portion 40*b* by gravity as shown by the dotted arrow into the empty cavity 202*a*; and the thus transferred ink permeates and is absorbed by the ink absorbing material 202. The ink is transferred from the ink supply container 210 to the ink absorbing material 202 until the ink inside the ink supply container 210 is fully transferred into the ink cartridge 200.

When the ink inside the ink supply container 210 is thus fully transferred into the ink cartridge 200 and the ink refill process is completed, the ink supply container 210 is removed from the adapter 10, the cap 26 (see FIG. 2(*a*)) is put on the guide collars 24 of the adapter 10, and the adapter 10 is pulled and removed from the ink cartridge 100. When the safety cap 26 is put on the guide collars 24, the outside pipe portion 40*a* pierces into the ink absorbing pad 26*a* by way of the pointed end thereof As a result, ink remaining inside the outside pipe portion 40*a* and inside pipe portion 40*b* is absorbed by the ink absorbing pad 26*a*; and ink is prevented from spilling when the adapter 10 is removed from the ink cartridge 200.

In case the transferred ink overflows from the air hole 204 of the ink cartridge 200 during the ink transferring process, the ink that has overflown is absorbed by the elastic member 60, which is a sponge as described above and is in contact with the inside pipe portion (inner pipe) 40*b* and with the upper surface of the raised box section 200*a*, and then spreads in the elastic member 60, so that the elastic member 60 that has thus absorbed the ink and is colored by the ink is seen through the observation cut-out 36. As a result, the ink refill process can be stopped immediately. It is preferable that white is selected as the color of the elastic member 60 so that the color change thereof caused by the ink can be easily observed. When the ink absorbing layer 62 is provided on the elastic member 60, the overflown ink is absorbed by the ink absorbing layer 62 and then spreads in the ink absorbing layer 62, so that the ink absorbing layer 62 that has thus absorbed the ink and is colored by the ink is seen through the observation cut-out 36. It is again thus preferable that white is selected as the color of the ink absorbing layer 62 so that the color change thereof can be easily observed.

The ink refilling adapter 10 in the above embodiment has the front wall 32 along with three side walls 30; however, the front wall 32 can be omitted so that the adapter 10 has only three surrounding walls or the side walls 30 with or without the observation cut-out 36.

Furthermore, the observation cut-out 36 of the above embodiment is provided as an indicator of an ink overflow, thus letting the user stop the ink transfer from the ink supply container into the ink cartridge. However, instead of providing the observation cut-out 36, the entire ink refilling adapter 10 or one or some of the side walls 30 of the ink refilling adapter 10 can be made transparent so that overflown ink which is absorbed by the elastic member 60 (and by the ink absorbing layer 62) can be seen through the transparent side walls 30.

FIGS. 5(*a*) through 5(*d*) show the second embodiment of the present invention. The ink refilling adapter of the second embodiment is adapted to be used in an ink cartridge that has a plurality of ink reservoir compartments containing ink absorbing material for different colored inks and therefore has a plurality of ink transfer conduits and it works in the same manner as in the first embodiment which has a single ink transfer conduit.

More specifically, the adapter 100 of the second embodiment comprises a base plate 120 and a plurality of ink transfer conduits 140 that are securely provided on and extend through the base plate 120. The base plate 120 has an outer surface 120*a* and under surface 120*b*; and the ink transfer conduits 140 are provided in the base plate 120 by way of a plurality of through holes (not shown) and outer and inner supports (not shown) in the same manner as in the first embodiment. Each one of the ink transfer conduits 140 comprises a single pipe (it can be indeed obtained from two pipes: inner and outer pipes); and in the shown embodiment, the through holes and therefore the ink transfer conduits are arranged in a zig-zag fashion. The positions and numbers of the through holes and the ink transfer conduits 140 are selected so that the through holes and ink transfer conduits 140 correspond to a plurality of ink filling apertures of the ink cartridge 200' upon which the adapter of the second embodiment is used. In the shown embodiment, the ink cartridge 200' has three ink reservoir compartments and three ink filling apertures which are arranged in a zig-zag fashion; accordingly, three (3) through holes and three (3) ink transfer conduits are provided in the adapter 100 in the corresponding zig-zag arrangement.

In addition, the base plate 120, that has a width substantially the same as the width of the ink cartridge 200' upon which the ink refilling adapter of the second embodiment is used, is provided, at both end thereof, with a pair of opposing side plates 130 that extend substantially at right angles relative to the base plate 120. The side plates 130 have a certain height below the base plate 120 (in FIG. 5(*a*)), and an interior space 134 is formed by the base plate 120 and the side plates 130.

An elastic member 150 is provided in the interior space 134. The elastic member 150 is a synthetic sponge substantially in the shape of a rectangular parallelpiped block having a size that can fit and stay in the interior space 134. The elastic member 150 can be glued to the under surface 120*b* of the base plate 120 (and to the side plates 130). The thickness or height H of the elastic member 150 is smaller than the height of the side plates 130 locating below the base plate 120, and the elastic member 150 covers substantially the entire under surface 120*b* of the base plate 120. Thus, two surfaces, or the front and rear surfaces, of the elastic member 150 (only the front surface shown in FIG. 5(*a*)) which are not covered by the side plates 130 are exposed.

Typically, the thickness or height H of the elastic member 150 is about half the length of the ink transfer conduits 140 located below the base plate 120 so that, as best seen in FIG. 5(*a*) about the upper half portion of the circumferential surface of each one of the ink transfer conduits 140 is in contact with the elastic member 150.

In use, resin plugs (not shown) closing the ink filling apertures of the ink cartridge 200' are pushed and dropped into the cartridge 200' using an appropriate tool, and three ink transfer conduits 140 of the ink refilling adapter 100 are inserted into the thus opened ink filling apertures with the side plates 130 being positioned on the side surfaces of the ink cartridge 200'; and when the lower surface of the elastic member 150 comes into contact with the upper surface of the ink cartridge 200, the adapter 100 is, as in the first embodiment, pushed down by hand towards inside of the ink cartridge 200', thus pressing and squeezing the elastic member 150 between the base plate 120 and the upper surface of the ink cartridge 200'.

With this pushing, the lower portions of the ink transfer conduits 140 penetrate into the ink absorbing material of the cartridge 200'; and then, when the pressing force is removed from the adapter 100, the elastic member 150 which has been squeezed starts expanding, gradually regaining its original block shape and thus raising the ink refilling adapter 100 and therefore the ink transfer conduits 140 which are secured to the base plate 120 of the adapter 100. Thus, when, as described in the first embodiment, the elastic block 150 fully regains its original shape and the ink transfer conduits 140 have been raised in the ink absorbing material, empty spaces or cavities are formed and remain in the ink absorbing material. As a result, ink supply containers, typically containing three different colored inks, are connected to the ink refilling adapter 100 and ink refilling is executed as in the first embodiment.

In case the transferred ink overflows from the ink filling apertures of the ink cartridge 200', the ink that has overflown is absorbed by the elastic member 150 and spreads therein; as a result, the elastic member 150 that has thus absorbed the ink and is colored by the ink is observed via the uncovered two surfaces of the elastic member 150, and the ink refill process can be stopped immediately. As in the first embodiment, the elastic member 150 may have an ink absorbing layer on its lower surface.

In the above two embodiments, the elastic members 50 and 150 are synthetic sponges; however, the elastic member can be a natural sponge, spring, rubbers or any other means that produces a resilient force after being pressed between the base plate and the upper surface of the ink cartridge.

Furthermore, the ink transfer conduit(s) 40 (and 140) in the above embodiments has a length in which the lower end thereof can stay inside the empty space(s) 202*a* when the elastic member 60 (150) has regained its original shape; however, the conduit(s) may have a length in which the lower end thereof is separated from the ink absorbing material 202 when the elastic member 60 (150) has regained its original shape as far as the conduit(s) is positioned straightly above the formed empty space(s) 202*a*.

Though particular embodiments of the invention are described above, it should be understood that the present disclosure is made by way of examples and that numerous changes in the details of construction and the combination and arrangement of parts may be resorted to without departing from the spirit and the scope of the invention.

I claim:

1. A device for refilling an ink into an ink cartridge that contains therein an ink absorbing material, said device comprising:

a base plate having a first surface and a second surface, said second surface facing said ink cartridge when said device is connected to said ink cartridge;

an ink transfer conduit provided in said base plate so as to extend from said first surface to said second surface on said base plate, a part of said ink transfer conduit extending from said second surface for penetrating into said ink absorbing material of said ink cartridge when said device is connected to said ink cartridge; and an elastic member having a specific height and provided on said second surface of said base plate, said elastic member for being squeezed between said base plate and said ink cartridge when said device is connected to said ink cartridge and a pressing force is applied on said base plate and then expand back to said specific height when said pressing force is removed from said base plate.

2. A device according to claim 1, wherein said elastic member is in contact with said ink transfer conduit.

3. A device according to claim 2, wherein said elastic member is made of a sponge.

4. A device according to claim 1, wherein said elastic member comprises a sponge block which is in contact with said part of said ink transfer conduit extending from said second surface.

5. An ink refilling adapter for refilling ink into an ink cartridge which contains therein an ink absorbing material, said adapter comprising:

a base plate and a plurality of surrounding walls, said base plate having an outer surface and an inner surface, and said surrounding walls extending at substantially right angles from edges of said base plate, thus forming an interior space defined by said base plate and said surrounding walls, said inner surface facing said ink cartridge when said adapter is connected to said ink cartridge;

an ink transfer conduit provided in said base plate so as to penetrate through said base plate, said conduit having an outer part extending from said outer surface of said base plate and an inner part extending from said inner surface of said base plate, and said inner part of said conduit being located inside said interior space and having a specific length for penetrating into said ink cartridge when said adapter is connected to said ink cartridge; and an elastic member provided inside said interior space so as to be in contact with said inner surface of said base plate, said elastic member for being squeezed between said base plate and said ink cartridge when said adapter is connected to said ink cartridge and a pressing force is applied onto said base plate so that said inner part of said conduit penetrates into said ink absorbing material of said ink cartridge and then said elastic member expanding when said pressing force is removed from said base plate so that said inner part of said conduit is raised, thus forming an empty space in said ink absorbing material and facilitating said ink to drip into said empty space by gravity.

6. An adapter according to claim 5, further comprising an observing means formed in one of said surrounding walls so that a part of said elastic member is exposed through said observing means.

7. An adapter according to claim 5, wherein at least one of said plurality of surrounding walls is made so as to be transparent.

8. An ink refilling adapter for refilling ink into an ink cartridge that contains an ink absorbing material therein, said ink refilling adapter comprising:

a base plate and a pair of opposing side plates provided at both ends of said base plate, said base plate having an outer surface and an inner surface, said inner surface for facing said ink cartridge when said adapter is connected to said ink cartridge;

a plurality of ink transfer conduits provided in said base plate so as to penetrate through said base plate, each of said plurality of conduits having an outer part extending from said outer surface of said base plate and an inner part extending from said inner surface of said base plate, and said inner part of each of said plurality of ink transfer conduits having a specific length for penetrating into said ink cartridge when said adapter is connected to said ink cartridge; and an elastic member provided on said inner surface of said base plate so as to be in contact with said inner surface of said base plate, said elastic member for being squeezed between said base plate and said ink cartridge when said adapter is connected to said ink cartridge and a pressing force is applied on said base plate so that said inner part of each of said plurality of conduits penetrates into said ink absorbing material of said ink cartridge and then said elastic member expands when said pressing force is removed from said base plate so that said inner part of each of said plurality of conduits is raised, thus forming an empty space in said ink absorbing material and facilitating said ink to drip into said empty space by gravity.

9. A method for refilling an ink cartridge that is provided with a fluid communication hole and contains therein an ink absorbing material, said method comprising the steps of:

connecting a device for refilling an ink cartridge to an ink cartridge, said device comprising a plate member, an ink transfer conduit extending through said plate member and an elastic member provided on said plate member;

introducing said ink transfer conduit provided in said plate member into said cartridge through said fluid communication hole so that one end of said ink transfer conduit enters into said ink absorbing material of said ink cartridge;

applying a pressing force on said plate member toward an inside of said ink cartridge, thus squeezing said elastic member provided on said plate member and having said end of said ink transfer conduit penetrate into said ink absorbing material;

removing said pressing force from said plate member, thus allowing said squeezed elastic member to expand and said ink transfer conduit to be raised so as to form an empty cavity in said ink absorbing material; and introducing ink into said empty cavity of said ink absorbing material through said ink transfer conduit.

10. A method according to claim 9, wherein said ink transfer conduit is raised for a distance which allows said one end of said ink transfer conduit to remain in said empty cavity.

* * * * *